US012577769B2

(12) United States Patent
Efrati et al.

(10) Patent No.: US 12,577,769 B2
(45) Date of Patent: Mar. 17, 2026

(54) ENVIRONMENTALLY SUSTAINABLE SYSTEMS AND METHODS OF TOILET FLUSHING AND BLACKWATER DISPOSAL

(71) Applicant: HOME BIOGAS LTD, Beit Yanai (IL)

(72) Inventors: Oshik Moshe Efrati, Bait Yanai (IL); Yossi Rosenblum, Pardesiya (IL); Guy Jordan, Magal (IL); Rami Hashimshony, Pardes hanna (IL)

(73) Assignee: HOME BIOGAS LTD, Bet Yanai (IL)

( * ) Notice: Subject to any disclaimer, the term of this patent is extended or adjusted under 35 U.S.C. 154(b) by 58 days.

(21) Appl. No.: 18/217,782

(22) Filed: Jul. 3, 2023

(65) Prior Publication Data

US 2025/0012063 A1 Jan. 9, 2025

(51) Int. Cl.
*E03D 5/00* (2006.01)
*E03D 1/34* (2006.01)
*E03D 5/01* (2006.01)

(52) U.S. Cl.
CPC ..... *E03D 5/003* (2013.01); *E03D 1/34* (2013.01); *E03D 5/01* (2013.01)

(58) Field of Classification Search
CPC ..... E03D 5/003; E03D 1/34; E03D 5/01
See application file for complete search history.

(56) References Cited

U.S. PATENT DOCUMENTS 3,868,731 A 3/1975 Stahl et al.
6,981,285 B2 1/2006 Sigler et al.
8,230,531 B2 7/2012 Miller et al.
8,490,223 B2 7/2013 Gell
9,404,247 B2 8/2016 Mehta et al.
10,358,809 B2 * 7/2019 Snyder ..... E03D 3/12
2007/0118981 A1 5/2007 Kovey
2013/0055498 A1 * 3/2013 Gell, III ..... E03D 5/01 4/434
2015/0225936 A1 * 8/2015 Mehta ..... B60R 15/04 4/321
2019/0264433 A1 * 8/2019 Ross-Kent ..... E03D 1/145
2020/0190782 A1 * 6/2020 Kochavi ..... E03D 1/286

FOREIGN PATENT DOCUMENTS

RU 52794 4/2006

* cited by examiner

*Primary Examiner* — Christine J Skubinna

(74) *Attorney, Agent, or Firm* — Mark S. Cohen; PEARL COHEN ZEDEK LATZER BARATZ LLP

(57) ABSTRACT

A environmentally sustainable system for toilet flushing and blackwater disposal is described; a respective method of toilet flushing and blackwater disposal by a mechanical system is further described; the system comprises: a toilet bowl, a bowl valve, a pumping mechanism, a check valve, a driving shaft, a gearing mechanism; the method comprises: collecting a blackwater, moving a sealing element, engaging the sealing element, disposing the sealing element, pumping the blackwater, conducting a flow of the blackwater, operationally connecting a driving shaft, operationally connecting in a predefined gearing ratio of operation the pumping mechanism with the bowl valve and with the driving shaft.

20 Claims, 4 Drawing Sheets

ENVIRONMENTALLY SUSTAINABLE SYSTEMS AND METHODS OF TOILET FLUSHING AND BLACKWATER DISPOSAL

TECHNICAL FIELD

In general, the present invention pertains to the art of mechanical engineering. In particular, the invention relates to environmentally sustainable systems and methods of toilet flushing and blackwater disposal.

BACKGROUND ART

It is believed that the current state of the art is represented by the following patent literature: U.S. Pat. Nos. 8,490,223, 3,868,731, 8,230,531, 9,404,247, 6,981,285, 10,358,809, US2007118981, RU52794 and CN2846547.

U.S. Pat. No. 8,490,223 that is believed to represent the closest prior art discloses a toilet includes a bowl with a receptacle to receive waste, with a secondary chamber, and with an opening in the receptacle to allow the waste to pass to the secondary chamber; a rinse pump that turns on to add an amount of rinsing water for cleaning the bowl; a flexible self-cleaning gasket configured around the opening formed in the receptacle; a bowl valve that has a sealing part having a rounded shape, rotates to a closed position that creates a sealed effect between the sealing part and the gasket trapping the waste and rinsing water in the receptacle of the bowl and sealing odors in the secondary chamber, and also rotates to an open position that sweeps the sealing part to be swept across the gasket and allowing the waste to pass to the secondary chamber. The solenoid rotates the bowl valve between the closed to open positions.

SUMMARY OF THE INVENTION

The following summary of the invention is provided to exhibit the basic understanding of some principles, underlying various aspects and features of the invention. This summary is not an extensive overview of the invention and as such it is not necessarily intended to particularly identify all key or critical elements of the invention and is not to delineate the scope of the invention. Its sole purpose is to present some concepts of the invention in a simplified form as a prelude to the following more detailed.

The invention was made in view of the deficiencies of the prior art and provides systems, methods and processes for overcoming these deficiencies. According to some embodiments and aspects of the present invention, there is provided an environmentally sustainable system for toilet flushing and blackwater disposal comprises: a toilet bowl configured to collect a blackwater, comprising an essentially semi-spherical shell shape, the toilet bowl comprising a bowl outlet, at a bottom portion of the essentially semi-spherical shell shape, configured to conduct a flow of the blackwater therethrough; a bowl valve disposed adjacently to the bowl outlet, in which the bowl valve comprising a movable sealing element, essentially matching the bowl outlet, configured upon movement of said sealing element for reversibly assuming: a bowl outlet sealing configuration in which the sealing element is engaged vis-à-vis the bowl outlet, thereby sealing the bowl outlet and obstructing the flow blackwater therethrough; an open configuration in which the sealing element is disposed offset the bowl outlet, thereby unsealing the bowl outlet and forming a conduit for flow of the blackwater therethrough.

According to some embodiments and aspects of the present invention, the system further comprises a pumping mechanism, operationally coupled downstream to the bowl valve, configured for controllably forming, in turn, a negative pressure downstream to the bowl valve and a positive pressure downstream to the bowl valve, thereby pumping the blackwater received from the bowl valve; a check valve, operationally coupled downstream to the pumping mechanism, configured to conduct a flow of the blackwater in a downstream direction relative to the check valve and to obstruct a flow of the blackwater in an upstream direction relative thereto; a driving shaft operationally connected to an actuator configured to exert a rotational torque onto the driving shaft; a gearing mechanism operationally connecting in a predefined gearing ratio of operation the pumping mechanism, with the bowl valve and with the driving shaft.

According to some embodiments and aspects of the present invention, for each single operational cycle of the system, the predefined gearing ratio of operation comprising: pumping mechanism performing at least one single operational cycle, in which each single operational cycle of the pumping mechanism comprises, in turn, forming the negative pressure downstream to the bowl valve and the positive pressure downstream to the bowl valve; the bowl valve performing a single operational cycle, in which each single operational cycle of the bowl valve comprises, in turn, sealing the bowl outlet and obstructing flow of the blackwater therethrough, and unsealing the bowl outlet and conduiting a flow of the blackwater therethrough; the driving shaft performing at least one single operational cycle, in which each single operational cycle of the driving shaft comprises at least a partial revolution about a longitudinal centerline in a predefined direction.

In some embodiments, the system further comprises an anti-backsplash check valve, disposed in-between the bowl valve and the pumping mechanism, effectively preventing a backflow of the blackwater in the upstream direction, from said pumping mechanism to said bowl valve.

In some embodiments, the actuator is a human-powered actuator, further comprising a convertor mechanism configured to convert an essentially linear reciprocating motion of the human-powered actuator into a successive rotational movement of the driving shaft in the predefined direction.

In some embodiments, the actuator is a human-powered actuator, further comprising a pedal-driven mechanism and/or a manual mechanism and/or a pedal, lever and/or a handle.

In some embodiments, the actuator is an electromechanical actuator, comprising an electrical motor-powered drive.

In some embodiments, the pumping mechanism is a diaphragm pump, in which the diaphragm is operationally connectable to the driving shaft.

In some embodiments, the system further comprises a flushing subsystem comprising a flushing water source, a controllable shutoff valve coupled to the flushing water source and configured to controllably conduct a flow of the flushing water from the source to the toilet bowl, in which a controller of the shutoff valve is operationally connectable to the driving shaft.

In some embodiments, the system further comprises a flushing shutoff valve, operationally connected to the driving shaft according to the predefined gearing ratio, in which for each single operational cycle of the system, the flushing shutoff valve performs a single operational cycle, in which each single operational cycle of the shutoff valve comprises, in turn, conducting a flow of a flushing water from the source to the toilet bowl for a predetermined period of time, and obstructing the flow of the flushing water from the source to the toilet bowl.

In some embodiments, according to the predefined gearing ratio, the single operational cycle of the bowl valve commences upon completion of a first phase of the single operational cycle, of the pumping mechanism.

In some embodiments, the system further comprises a biasing means, configured to accumulate a potential mechanical energy for at least one member selected from the group consisting of: performing the single operational cycle of the system, performing at least one single operational cycle by the driving shaft, returning the human-powered actuator into an initial position.

In some embodiments, the system further comprises a ratcheting mechanism, operationally coupled to the bowl valve, configured to drive the bowl valve into the open configuration, only upon movement of the driving shaft corresponding to a second phase of the single operational cycle, of the pumping mechanism.

In some embodiments, the bowl valve is normally closed, being disposed in the bowl outlet sealing configuration, in which the system is idling.

In some embodiments, the system further comprises a blackwater reservoir, operationally coupled downstream to the check valve, configured to store the blackwater pumped by the pumping mechanism through the check valve. The term check valve, as referred to herein, is intended to encompass any type of unidirectional valve, in a non-limiting manner including a joker valve and duckbill valve.

In some embodiments, the blackwater reservoir is disposed at an altitude essentially exceeding an altitude of the pumping mechanism.

In some embodiments, the system further comprises a sealable access hatch, disposed at an anterior portion of the system, configured to provide an access for maintenance and replacement.

According to some embodiments and aspects of the present invention, there is provided an environmentally sustainable method of toilet flushing and blackwater disposal by a mechanical system comprises: collecting a blackwater in a toilet bowl and conducting a flow of the blackwater from the toilet bowl through a bowl outlet at a bottom portion thereof; moving a sealing element of a bowl valve adjacently to the bowl outlet; engaging the sealing element is vis-à-vis the bowl outlet, thereby sealing the bowl outlet and obstructing flow of the blackwater therethrough; disposing the sealing element offset the bowl outlet, thereby unsealing the bowl outlet and forming a conduit for flow of the blackwater therethrough; pumping the blackwater downstream to the bowl valve, by forming, in turn, a negative pressure to the bowl valve and a positive pressure downstream to the bowl valve; conducting a flow of the blackwater in a downstream direction relative to the pumping mechanism and obstructing the flow of the blackwater in an upstream direction relative thereto; operationally connecting a driving shaft to an actuator and exerting a rotational torque onto the driving shaft; operationally connecting in a predefined gearing ratio of operation the pumping mechanism with the bowl valve and with the driving shaft; for each single operational cycle of the system, according to the predefined gearing ratio of operation: performing at least one single operational cycle by the pumping mechanism in which each single operational cycle of the pumping mechanism comprises, in turn, forming the negative pressure downstream to the bowl valve and the positive pressure downstream to the bowl valve; performing a single operational cycle by the bowl valve in which each single operational cycle of the bowl valve comprises, in turn, sealing the bowl outlet and obstructing flow of the blackwater therethrough, and unsealing the bowl outlet and conduiting a flow of the blackwater therethrough; performing at least one single operational cycle by the driving shaft, in which each single operational cycle of the driving shaft comprises at least a partial revolution in a predefined direction.

In some embodiments, the method further comprises effectively preventing a backflow of the blackwater in the upstream direction, from the pumping mechanism to the bowl valve, by an anti-backsplash check valve, disposed in-between the bowl valve and the pumping mechanism.

In some embodiments, the actuator is a human-powered actuator, comprising a convertor mechanism, further comprises configured converting an essentially linear reciprocating motion of the human-powered actuator into a successive rotational movement of the driving shaft in the predefined direction.

In some embodiments, the actuator is a human-powered actuator, comprising at least one member selected from the group consisting of: a pedal-driven mechanism, manual mechanism, pedal, lever and handle, further comprises exerting a human force onto the actuator.

In some embodiments, the actuator is an electromechanical actuator, comprising an electrical motor-powered drive, further comprises powering up the electrical motor.

In some embodiments, the pumping mechanism is a diaphragm pump, in which the diaphragm, further comprises operationally connecting the diaphragm to the driving shaft.

In some embodiments, the method further comprises controllably conducting a flow of a flushing water from a flushing water source to the toilet bowl, further comprises operationally connecting a controller of a controllable shutoff valve to the driving shaft.

In some embodiments, the method further comprises performing by the flushing shutoff valve a single operational cycle, in which each single operational cycle of the shutoff valve comprises, in turn, conducting a flow of the flushing water from the source to the toilet bowl for a predetermined period of time, and obstructing the flow of the flushing water from the source to the toilet bowl.

In some embodiments, the predefined gearing ratio further comprises commencing the single operational cycle of the bowl valve upon completion of a first of the single operational cycle, of the pumping mechanism.

In some embodiments, the method further comprises accumulating a potential mechanical energy by a biasing means, further comprises at least one member selected form the group consisting of: performing said single operational cycle of the system; performing at least one single operational cycle by the driving shaft; returning the human-powered actuator into an initial position.

In some embodiments, the method further comprises driving the bowl valve into the open configuration by a ratcheting mechanism, operationally coupled to the bowl valve, only upon movement of the driving shaft corresponding to a second phase of the single operational cycle, of the pumping mechanism.

In some embodiments, the method further comprises storing the blackwater pumped by the pumping mechanism through the check valve into a blackwater reservoir.

In some embodiments, the method further comprises providing an access for maintenance and replacement thought by a sealable access hatch.

Definitions

The term matching or a term similar thereto, as referred to herein, is to be construed as having a cross-sectional area and/or shape of a component equal or essentially similar to a cross-sectional area and/or shape of another component. It should be acknowledged that the components may only to be similar in the cross-sectional areas and/or shapes, to satisfy the term matching or similar, so long as the cross-sectional areas of the components can be mated and/or inserted into each other and/or the combination thereof essentially fits together and/or occupy essentially the same space.

The term structured, as referred to herein, is to be construed as including any geometrical shape, exceeding in complexity a plain linear shape or a shape embodying a simple and/or standardized circular, elliptical or polygonal contour or profile. Any more complex shape than a plain linear shape or a shape embodying a simple and/or standardized circular, elliptical or polygonal contour or profile, constitutes an example of structured geometry.

The term modular, as referred to herein, should be construed as a including a stand-alone and/or autonomically functioning of structured unit. The term modular inter alia means a standardized unit that may be conveniently installed or deployed without significant impact to the environment. The term modular, however, doesn't necessarily mean providing for ease of interchange or replacement. The term modular is optionally satisfied solely by providing for ease of onetime deployment or installation.

The term readily connectable, as referred to herein, should be construed as including any structure and/or member that is configured to be conveniently connected to other structure and/or member and/or components of a larger system or assembly. The term readily connectable, however, doesn't necessarily mean readily disconnectable or removable. The term readily connectable is optionally satisfied by providing for ease of onetime connection or coupling.

The term biasing means or alike, as referred to herein, should be construed as including any material, structure or mechanism, configured to accumulate mechanical energy, by changing the configuration thereof, upon a force exerted thereon, such as a compressive, tensile, shear or torsional force, as well as for releasing the energy accumulated therein, by returning to the normal or default configuration thereof and thereby performing a mechanical work, typically by linear or radial displacement. Examples of biasing means in a non-limiting manner include, springs, elastomers, leaf-springs, coil-springs, tension/extension spring, compression spring torsion spring, constant spring, variable spring, variable stiffness spring, flat spring, machined spring, serpentine spring, garter spring, cantilever spring, helical spring, hollow tubing springs, volute spring, V-spring, belleville washer or belleville spring, constant-force spring, gas spring, mainspring, negator spring, progressive rate coil springs, rubber band, spring washer and wave spring.

By operationally connected and operably coupled or similar terms used herein is meant connected in a specific way (e.g., in a manner allowing fluid to move and/or electric power or signal to be transmitted) that allows the disclosed system and its various components to operate effectively in the manner described herein.

The term environmentally sustainable, as referred to herein, is to be construed as including any material that is biodegradable or comprising a naturally occurring and/or excavated and/or mined material, whether in original, natural or processed form. The term environmentally sustainable, as referred to herein, is to be equally construed as including in a non-limiting manner any method or technique facilitating a reduction in: (1) energy consumption including energy consumption, whether required for manufacture, storage and/or transportation, (2) the volume or mass of disposed materials, waste or emissions, as well as (3) toxicity or non-biodegradability of disposed materials, waste or emissions.

The term greywater (also spelled gray water in the United States) or sullage, as referred to herein, is to be interpreted as all the wastewater without fecal contamination. Examples of sources of greywater include sinks, showers, baths, washing machines or dishwashers. As greywater contains fewer pathogens than domestic wastewater, it is generally safer to handle and easier to treat and reuse onsite.

The terms wastewater and/or blackwater, as referred to herein, may be used interchangeably and to be interpreted as sewage that generally is considered to comprise about 99% water and about 1% organic compounds, but includes pathogenic bacteria and human feces. In some embodiments, the wastewater comprises about 95% water by weight and about 5% organic compounds (aliphatic and organic) as well as metals, including heavy metals. In some embodiments, the salinity of the wastewater is typically fresh or brackish, having a TDS of between 400 and 1500 mg/L.

The term fluid or liquid, as referred to herein, is to be construed as any material that deforms when a shear stress is applied. While fluid generally would refer to any liquids or gases, it may be used herein to describe fluidized solids and bulk solids and/or granulate matter that are capable of flowing or otherwise moving inside a device as a result of pressure differences and/or gravitational force. Such materials may include slurries, suspensions, pastes, powders, granular solids, particle solids, granulate matter, particulate matter, as well as any combinations thereof.

The terms firm rigid, or stiff, as referred to herein, are to be construed as having rigidity modulus value, otherwise referred to as the shear modulus, of 4800 MPa or more. Materials are considered to be firm rigid, or stiff but not tensile, when such materials are incapable of being efficiently elastically flexed or bent. Stiff materials, such as steel, are defined as having rigidity modulus value well exceeding 4800 MPa.

The terms pliable or pliant, as referred to herein, are to be construed as having high tensile strength and capable of being efficiently elastically flexed or bent but not being resilient and incapable of being efficiently stretched or expanded. The term tensile or tensile strength, as referred to herein, is to be construed inter alia as a shortcut of the known term ultimate tensile strength, frequently represented acronym as UTS, meaning an intensive property of a material or structure to withstand loads tending to elongate, namely to resist tension, defined as the maximum stress that a material can withstand while been stretched or pulled before sustaining breaking, substantial deformation and/or necking before fracture, such as nylon, relating to essentially non-ductile materials, having UTS value ranging between about 600 and 1000 MPa or more, but not including rigid, firm or stiff materials.

The terms elastic or resilient, as referred to herein, are to be construed as having tensile strength lower than aforesaid tensile strength of pliable or pliant material and optionally being capable of efficiently stretching or expanding, relating inter alia to essentially ductile materials, having UTS value lesser than about 600 MPa.

The term water shall particularly include water that is fit for consumption by a living organism and/or make the water potable. In certain embodiments the living organism is a "mammal" or "mammalian", where these terms are used broadly to describe organisms which are within the class mammalia, including the orders carnivore, rodentia and primates or humans. In some embodiments of the disclosed systems, desalination is removing an amount of salt and/or other minerals or components from saline water so that the water is fit for a specific purpose (e.g., irrigation or industry).

The term slurry, as referred to herein, is to be construed as a mixture of solids denser than water suspended in liquid, usually water. Solids concentrations in a slurry typically range between about 0.5 percent and about 5 percent.

The term sludge, as referred to herein, is to be construed as a semi-solid slurry. The term is also sometimes used as a generic term denoting solids separated from suspension in a liquid. Solids concentrations in a sludge typically range between about 5 percent and about 15 percent.

The terms method and process as used herein are to be construed as including any sequence of steps or constituent actions, regardless a specific timeline for the performance thereof. The particular steps or constituent actions of any given method or process are not necessarily in the order they are presented in the claims, description or flowcharts in the drawings, unless the context clearly dictates otherwise. Any particular step or constituent action included in a given method or process may precede or follow any other particular step or constituent action in such method or process, unless the context clearly dictates otherwise. Any particular step or constituent action and/or a combination thereof in any method or process may be performed iteratively, before or after any other particular step or action in such method or process, unless the context clearly dictates otherwise. Moreover, some steps or constituent actions and/or a combination thereof may be combined, performed together, performed concomitantly and/or simultaneously and/or in parallel, unless the context clearly dictates otherwise. Moreover, some steps or constituent actions and/or a combination thereof in any given method or process may be skipped, omitted, spared and/or opted out, unless the context clearly dictates otherwise.

In the specification or claims herein, any term signifying an action or operation, such as: a verb, whether in base form or any tense, gerund or present/past participle, is not to be construed as necessarily to be actually performed but rather in a constructive manner, namely as to be performed merely optionally or potentially.

The term substantially as used herein is a broad term, and is to be given its ordinary and customary meaning to a person of ordinary skill in the art (and is not to be limited to a special or customized meaning), and refers without limitation to being largely but not necessarily entirely of that quantity or quality which is specified.

The term essentially means that the composition, method or structure may include additional ingredients, stages and or parts, but only if the additional ingredients, the stages and/or the parts do not materially alter the basic and new characteristics of the composition, method or structure claimed.

As used herein, the term essentially changes a specific meaning, meaning an interval of plus or minus ten percent (±10%). For any embodiments disclosed herein, any disclosure of a particular value, in some alternative embodiments, is to be understood as disclosing an interval approximately or about equal to that particular value (i.e., ±10%).

As used herein, the terms about or approximately modify a particular value, by referring to a range equal to the particular value, plus or minus twenty percent (+/−20%). For any of the embodiments, disclosed herein, any disclosure of a particular value, can, in various alternate embodiments, also be understood as a disclosure of a range equal to about that particular value (i.e. +/−20%).

As used herein, the term or is an inclusive or operator, equivalent to the term and/or, unless the context clearly dictates otherwise; whereas the term and as used herein is also the alternative operator equivalent to the term and/or, unless the context clearly dictates otherwise.

It should be understood, however, that neither the briefly synopsized summary nor particular definitions hereinabove are not to limit interpretation of the invention to the specific forms and examples but rather on the contrary are to cover all modifications, equivalents and alternatives falling within the scope of the invention.

DESCRIPTION OF THE DRAWINGS

The present invention will be understood and appreciated more comprehensively from the following detailed description taken in conjunction with the appended drawings in which.

Figure 1:
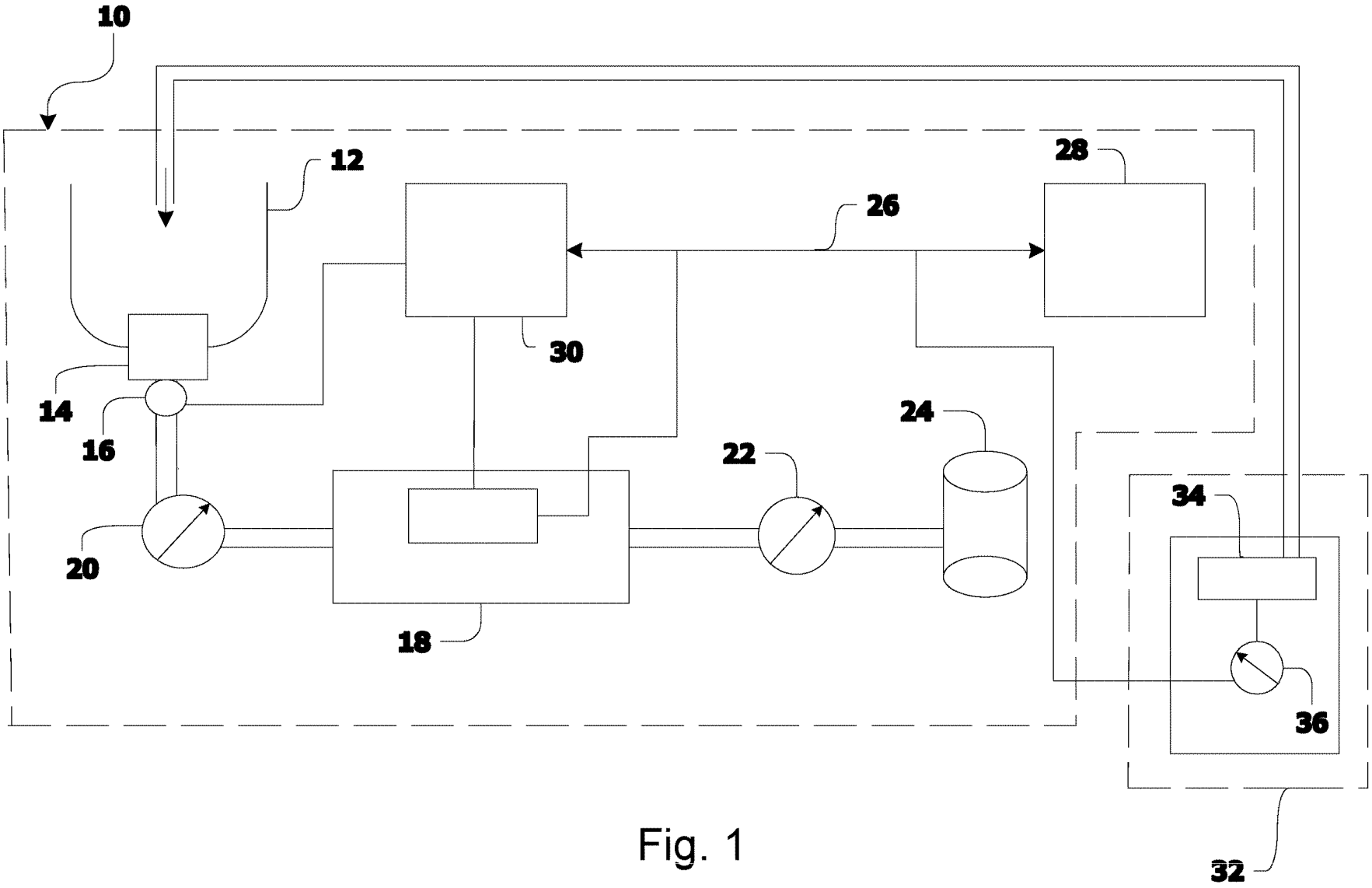
FIG. 1 is a schematic block diagram of an environmentally sustainable system for toilet flushing and blackwater disposal, according to some embodiments of the present invention.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DISCLOSURE OF EMBODIMENTS

Illustrative embodiments of the invention are described below. In the interest of clarity, not all features of actual implementation are described in this specification. It should be appreciated that various features or elements described in the context of some embodiment may be interchangeable with features or elements of any other embodiment described in the specification. Moreover, it will be appreciated that for the development of any actual embodiment, numerous implementation-specific decisions must be made to achieve the developers' specific goals, such as compliance with technology- or business-related constraints, which may vary from one implementation to another, and the effort of such a development might be complex and time-consuming, but would nevertheless be a routine undertaking for those of ordinary skill in the art having the benefit of this disclosure.

In accordance with some embodiments of the present invention, reference is now made to FIG. 1, showing a block diagram of environmentally sustainable system 10 for toilet flushing and blackwater disposal. Environmentally sustainable system 10 comprises toilet bowl 12. Toilet bowl 12 is configured to collect blackwater. Toilet bowl 12 comprises an essentially semi-spherical shell shape. In some embodiments, toilet bowl 12 comprises bowl outlet 14, at a bottom portion of the essentially semi-spherical shell shape. Bowl outlet 14 is configured to conduct the blackwater collected at toilet bowl 12 therethrough.

In some embodiments, system 10 further comprises bowl valve 16, disposed adjacently to bowl outlet 14. In some embodiments, bowl valve 16 comprises a movable sealing element, essentially matching the shape of bowl outlet 14. Upon movement of the sealing element, bowl valve 16 is configured to reversibly assume: (i) a bowl outlet sealing configuration, and (ii) an open configuration. In some embodiments, bowl valve 16 is normally closed, being disposed in the bowl outlet sealing configuration, whilst system 10 is idling.

In some embodiments, bowl valve 16 assumes the bowl outlet sealing configuration, in which the sealing element is engaged vis-à-vis bowl outlet 14, thereby sealing the bowl outlet 14 and obstructing the flow blackwater therethrough. In some embodiments, bowl valve 16 assumes an open configuration, in which the sealing element is disposed offset bowl outlet 14, thereby unsealing bowl outlet 14 and forming a conduit for the blackwater therethrough.

In some embodiments, environmentally sustainable system 10 further comprises pumping mechanism 18. In some embodiments, pumping mechanism 18 is operationally coupled downstream to bowl valve 16. Pumping mechanism 18 is configured for controllably forming, in turn: (i) a negative pressure downstream to bowl valve 16, and (ii) a positive pressure downstream to bowl valve 16, thereby facilitating the pumping of blackwater received from bowl valve 16.

In some embodiments, system 10 further comprises anti-backsplash check valve 20. Anti-backsplash check valve 20 is disposed in-between bowl valve 16 and pumping mechanism 18. Anti-backsplash check valve 20 is configured for effectively preventing a backflow of the blackwater in the upstream direction, from pumping mechanism 18 to bowl valve 16.

In some embodiments, system 10 further comprises check valve 22. In some embodiments, check valve 22 is operationally coupled downstream to pumping mechanism 18. In some embodiments, check valve 22 is configured to conduct a flow of the blackwater in a downstream direction relative thereto. In some embodiments, check valve 22 is configured to obstruct a flow of the blackwater in an upstream direction relative thereto.

In some embodiments, environmentally sustainable system 10 further comprises blackwater reservoir 24. Blackwater reservoir 24 is operationally coupled downstream to check valve 22. Blackwater reservoir 24 is configured to store the blackwater pumped by pumping mechanism 18 through check valve 22. In some embodiments, blackwater reservoir 24 is disposed at an altitude essentially exceeding the altitude of pumping mechanism 18.

In some embodiments, environmentally sustainable system 10 further comprises driving shaft 26. Driving shaft 26 is operationally connected to actuator 28, configured to exert a rotational torque onto driving shaft 26. In some examples, pumping mechanism 18 is a diaphragm pump, in which the diaphragm is operationally connectable to driving shaft 26.

In some embodiments, actuator 28 is a human-powered actuator, further comprising a convertor mechanism configured to convert an essentially linear reciprocating motion of the human-powered actuator into a successive rotational movement of driving shaft 26 in a predefined direction. In some examples, the human-powered actuator is in a non-limiting manner at least one of: a pedal-driven mechanism, manual mechanism, pedal, lever and handle. In some embodiments, actuator 28 is an electromechanical actuator, comprising an electrical motor-powered drive.

In some embodiments, system 10 further comprises gearing mechanism 30. Gearing mechanism 30 operationally connects pumping mechanism 18 with bowl valve 16 and with driving shaft 26, in a predefined gearing ratio of operation.

In some embodiments, for each single operational cycle of system 10, the predefined gearing ratio of operation comprises pumping mechanism 18 performing at least one single operational cycle. In some embodiments, each single operational cycle of pumping mechanism 18 comprises, in turn, forming negative pressure downstream to bowl valve 16 and then forming positive pressure downstream to bowl valve 16. In some embodiments, each single operational cycle of pumping mechanism 18 comprises, in turn, forming positive pressure downstream to bowl valve 16 and then negative pressure downstream to bowl valve 16.

In some embodiments, for each single operational cycle of system 10, the predefined gearing ratio of operation comprises bowl valve 16 performing a single operational cycle, in which each single operational cycle of bowl valve 16 comprises, in turn, sealing bowl outlet 14 and obstructing flow of the blackwater therethrough, and unsealing bowl outlet 14 and conduiting a flow of the blackwater therethrough. In some embodiments, according to the predefined gearing ratio, the single operational cycle of bowl valve 16 commences upon completion of a first phase of the single operational cycle, of pumping mechanism 18.

In some embodiments, for each single operational cycle of system 10, the predefined gearing ratio of operation comprises driving shaft 26 performing at least one single operational cycle, in which each single operational cycle of driving shaft 26 comprises at least a partial revolution about a longitudinal centerline in a predefined direction.

In another embodiment, for each single operational cycle of system 10, the predefined gearing ratio of operation comprises pumping mechanism 18 performing two successive operational cycles, in which each single operational cycle of pumping mechanism 18 comprises, in turn, forming the negative pressure downstream to bowl valve 16 and the positive pressure downstream to bowl valve 16.

In another embodiment, for each single operational cycle of system 10, the predefined gearing ratio of operation comprises driving shaft 26 performing two successive operational cycles, in which each single operational cycle of driving shaft 26 comprises at least a partial revolution about a longitudinal centerline in a predefined direction.

In some embodiments, environmentally sustainable system 10 further comprises flushing subsystem 32. Flushing subsystem 32 comprises flushing water source 34, a controllable shutoff valve 36 coupled to flushing water source 34. Flushing subsystem 32 is configured to controllably conduct a flow of the flushing water from source 34 to toilet bowl 12. In some embodiments, a controller of flushing shutoff valve 36 is operationally connectable to driving shaft 26.

In some embodiments, flushing shutoff valve 36 is operationally connected to driving shaft 26 according to the predefined gearing ratio, in which for each single operational cycle of system 10, flushing shutoff valve 36 performs a single operational cycle. In some embodiments, each single operational cycle of shutoff valve 36 comprises, in turn, conducting flushing water from source 34 to toilet bowl 12, for a predetermined period of time, and then obstructing the flow of the flushing water from source 34 to toilet bowl 12.

In some embodiments, system 10 further comprises a biasing means. The biasing means is configured to accumulate a potential mechanical energy for: (i) completing the operation of a single operational cycle of system 10 and/or (ii) performing at least one single operational cycle by driving shaft 26 and/or (iii) returning the human-powered actuator into an initial position.

In some embodiments, system 10 further comprises a ratcheting mechanism 15, operationally coupled to bowl valve 16, via mechanical coupling 17. The ratcheting mechanism is configured to drive bowl valve 16 into the open configuration, only upon movement of driving shaft 26, corresponding to a second phase of a single operational cycle, of pumping mechanism 18. The term ratcheting mechanism, as referred to herein, is intended to encompass any type of mechanical device configured to perform a single output revolution or a half of a single output revolution, upon receiving a half of a single input revolution or a pair of single input revolutions, respectively; such as in a non-limiting manner including a mechanical binary flip counter device.

Figure 2:
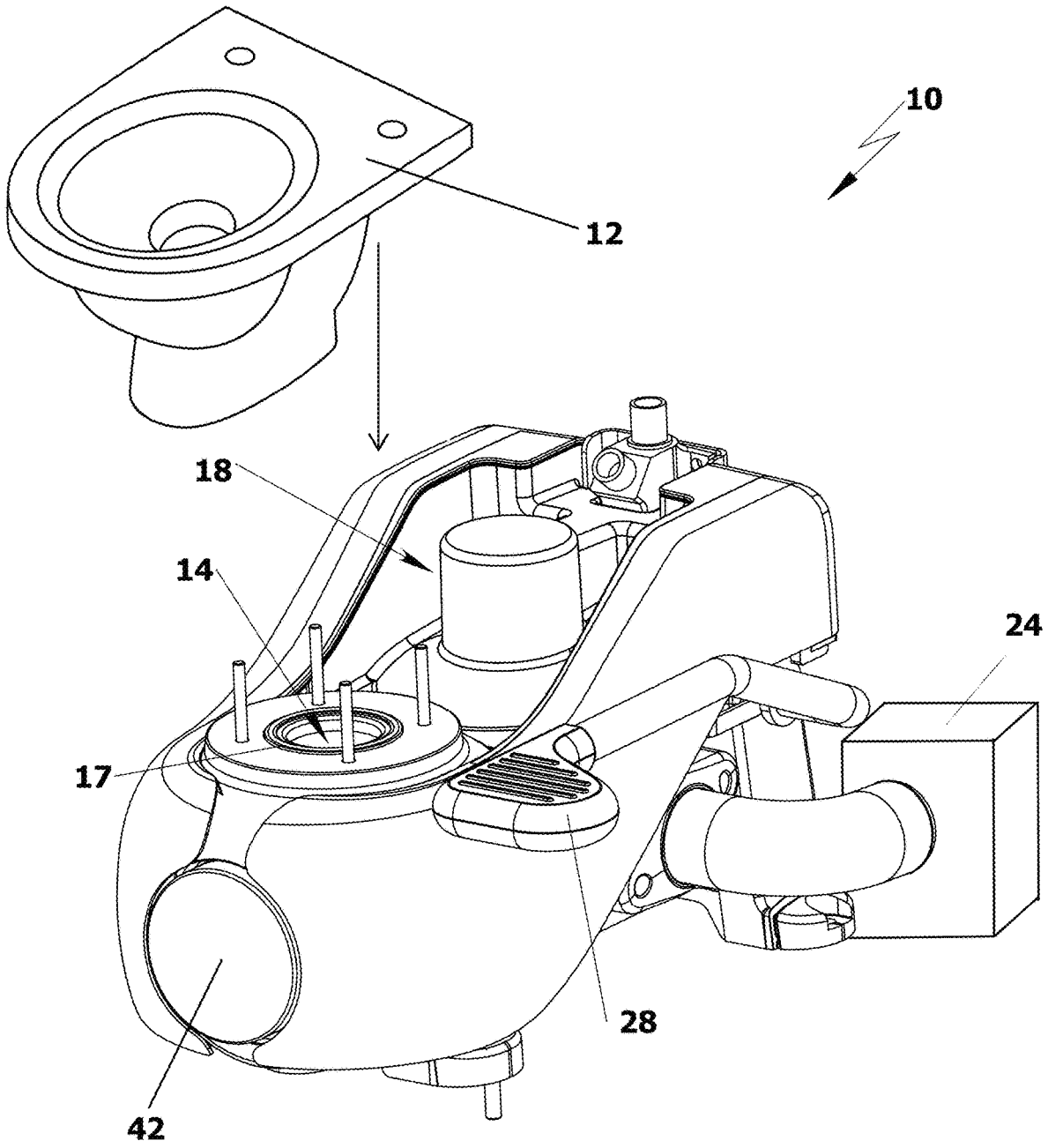
FIG. 2 is a perspective view of an environmentally sustainable device for toilet flushing and blackwater disposal, according to some embodiments of the present invention.
Figure 3:
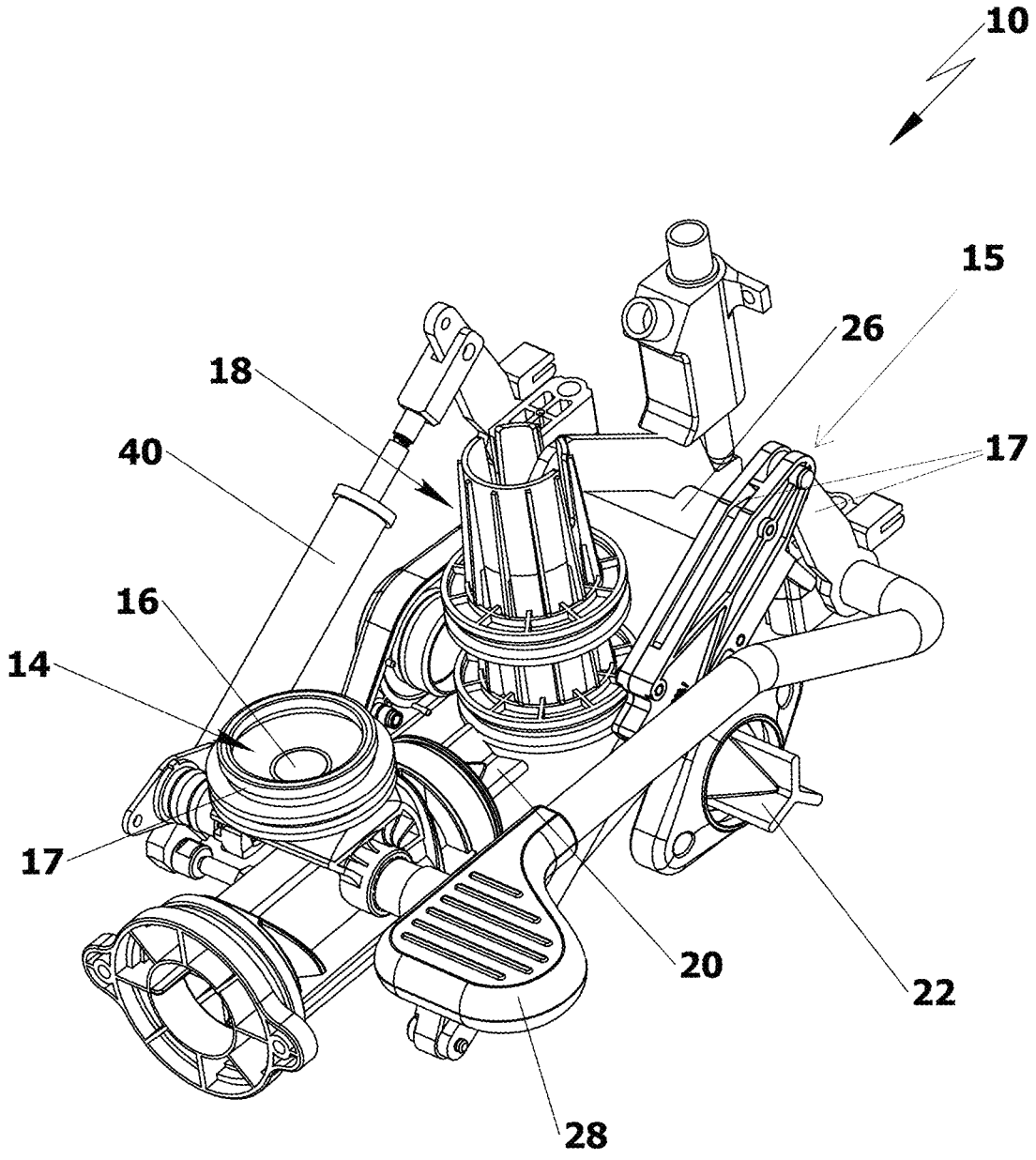
FIG. 3 is a perspective partially-disassembled view of an environmentally sustainable device for toilet flushing and blackwater disposal, according to some embodiments of the present invention.

In accordance with some embodiments of the present invention, reference is now made to FIGS. 2 and 3, showing environmentally sustainable device 10 for toilet flushing and blackwater disposal. Device 10 of the embodiments of FIGS. 2 and 3 illustrates various features that may be interchangeable with elements and/or features of any other embodiment described in the specification.

In some embodiments, device 10 comprises a toilet bowl. In some embodiments, the toilet bowl comprises an essentially semi-spherical shell shape. In some embodiments, the toilet bowl comprises bowl outlet 14, typically at a bottom portion of the essentially semi-spherical shell shape. Bowl outlet 14 is configured to conduct blackwater therethrough.

In some embodiments, device 10 further comprises bowl valve 16, disposed adjacently to bowl outlet 14. In some embodiments, bowl valve 16 is normally closed, being disposed in the bowl outlet sealing configuration, preferably whilst system 10 is idling. In some embodiments, bowl valve 16 comprises movable sealing element 17, shown in FIG. 3, essentially matching bowl outlet 14. Sealing element 17 is configured for reversibly assuming upon movement a bowl outlet sealing configuration and an open configuration.

In other embodiments, sealing element 17, shown in FIG. 3, of bowl valve 16, essentially matching bowl outlet 14 is stationary, whereas bowl valve 16 is movable relative to sealing element 17, to reversibly assume upon movement a bowl outlet sealing configuration and an open configuration.

In some embodiments and configurations, bowl valve 16 assumes a bowl outlet sealing configuration, in which sealing element 17 is engaged vis-à-vis bowl outlet 14, thereby sealing the bowl outlet 14 and obstructing the flow of blackwater therethrough. In some embodiments and configurations, bowl valve 16 assumes an open configuration, in which sealing element 17 is disposed offset bowl outlet 14, thereby unsealing bowl outlet 14 and forming a conduit for flow of blackwater therethrough.

In some embodiments, device 10 further comprises pumping mechanism 18. Pumping mechanism 18 is operationally coupled downstream to bowl valve 16. Pumping mechanism 18 is configured for controllably forming negative pressure downstream to bowl valve 16 and, in turn, positive pressure downstream to bowl valve 16, thereby pumping the blackwater received from bowl valve 16.

In some embodiments, device 10 further comprises anti-backsplash check valve 20, shown in FIG. 3. Anti-backsplash check valve 20 is disposed in-between bowl valve 16 and pumping mechanism 18. Anti-backsplash check valve 20 is configured for effectively preventing a backflow of blackwater in the upstream direction, from pumping mechanism 18 to bowl valve 16.

In some embodiments, device 10 further comprises check valve 22, shown in FIG. 3. Check valve 22 is operationally coupled downstream to pumping mechanism 18. Check valve 22 is configured to conduct a flow of blackwater in a downstream direction relative thereto. Check valve 22 is configured to obstruct a flow of blackwater in an upstream direction relative thereto.

In some embodiments, device 10 further comprises a blackwater reservoir. The blackwater reservoir is operationally coupled downstream to check valve 22. In some embodiments, the blackwater reservoir is disposed at an altitude essentially exceeding the altitude of pumping mechanism 18.

In some embodiments, device 10 further comprises driving shaft 26, shown in FIG. 3. Driving shaft 26 is operationally connected to actuator 28, configured to exert a rotational torque onto driving shaft 26.

In some embodiments, device 10 further comprises a gearing mechanism. The gearing mechanism operationally connects pumping mechanism 18 with bowl valve 16 and with driving shaft 26, in a predefined gearing ratio of operation.

In some embodiments, for each single operational cycle of device 10, the predefined gearing ratio of operation comprises pumping mechanism 18 performing at least one single operational cycle. In some embodiments, each single operational cycle of pumping mechanism 18 comprises, in turn, forming negative pressure downstream to bowl valve 16 and then, in turn, forming positive pressure downstream to bowl valve 16.

In some embodiments, for each single operational cycle of device 10, the predefined gearing ratio of operation comprises bowl valve 16 performing a single operational cycle. In some embodiments, each single operational cycle of bowl valve 16 comprises sealing bowl outlet 14 and obstructing flow of the blackwater therethrough and then, in turn, unsealing bowl outlet 14 and conduiting a flow of blackwater therethrough. In some embodiments, according to the predefined gearing ratio, the single operational cycle of bowl valve 16 commences upon completion of a first phase of the single operational cycle, of pumping mechanism 18, namely upon forming of negative pressure by pumping mechanism 18.

In some embodiments, for each single operational cycle of device 10, the predefined gearing ratio of operation comprises driving shaft 26 performing at least one single operational cycle. In some embodiments, each single operational cycle of driving shaft 26 comprises at least a partial revolution about a longitudinal centerline in a predefined direction.

In another embodiment, for each single operational cycle of device 10, the predefined gearing ratio of operation comprises pumping mechanism 18 performing two successive operational cycles, in which each single operational cycle of pumping mechanism 18 comprises, in turn, forming negative pressure downstream to bowl valve 16 and positive pressure downstream to bowl valve 16. According to the predefined gearing ratio, the single operational cycle of bowl valve 16 commences upon completion of a first phase of two successive operational cycles, of pumping mechanism 18.

In another embodiment, for each single operational cycle of device 10, the predefined gearing ratio of operation comprises bowl valve 16 performing a single operational cycle, in which each single operational cycle of bowl valve 16 comprises, in turn, sealing bowl outlet 14 and obstructing flow of the blackwater therethrough, and unsealing bowl outlet 14 and conduiting a flow of the blackwater therethrough. In some embodiments, according to the predefined gearing ratio, the single operational cycle of bowl valve 16 commences upon completion of a first of the two successive operational cycles, of pumping mechanism 18.

In another embodiment, for each single operational cycle of device 10, the predefined gearing ratio of operation comprises driving shaft 26 performing two successive operational cycles, in which each single operational cycle of driving shaft 26 comprises at least a partial revolution about a longitudinal centerline in a predefined direction.

In some embodiments, device 10 further comprises a flushing subsystem. The flushing subsystem comprises a flushing water source, a controllable shutoff valve coupled to the flushing water source. The flushing subsystem is configured to controllably conduct a flow of the flushing water from the source to toilet bowl 12.

In some embodiments, a controller of the shutoff valve is operationally connectable to the driving shaft. In some embodiments, the flushing shutoff valve is operationally connected to driving shaft 26 according to the predefined gearing ratio, in which for each single operational cycle of device 10, the flushing shutoff valve performs a single operational cycle. In some embodiments, each single operational cycle of the shutoff valve comprises, in turn, conducting a flow of flushing water from the source to toilet bowl 12 for a predetermined period of time, and then obstructing the flow of flushing water from the source to toilet bowl 12.

In some embodiments, device 10 further comprises biasing means 40. Biasing means 40 is configured to accumulate a potential mechanical energy for completing the performing of a single operational cycle of device 10 and/or performing at least one single operational cycle by driving shaft 26 and/or returning the human-powered actuator into an initial position.

In some embodiments, device 10 further comprises sealable access hatch 42. Sealable access hatch 42 is disposed at an anterior portion of device 10. Sealable access hatch 42 is configured to provide an access for maintenance, repair and part replacement of device 10.

Figure 4:
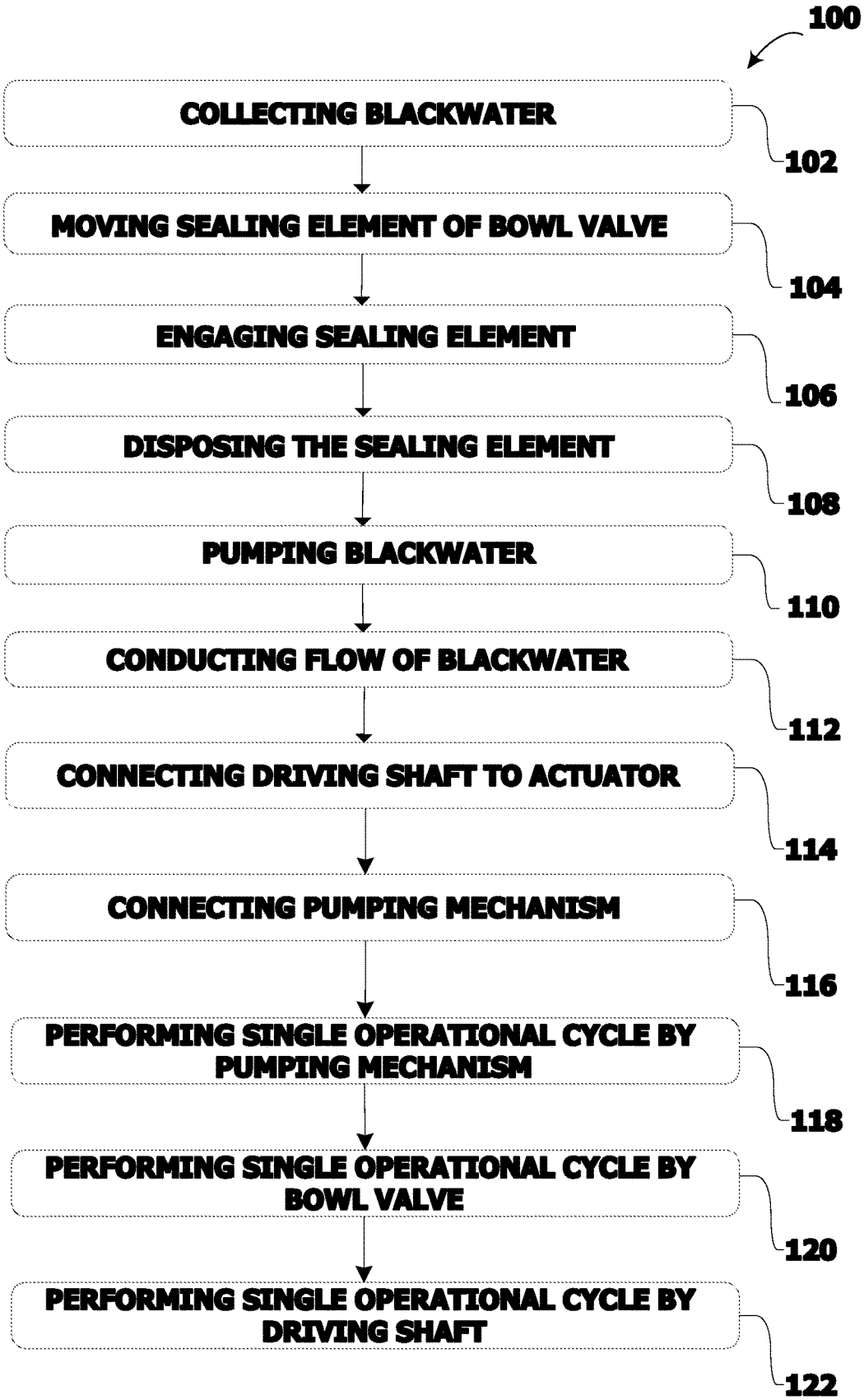
FIG. 4 is a flowchart of a method of a toilet flushing and blackwater disposal by a mechanical system, according to some embodiments of the present invention.

In accordance with some embodiments of the present invention, reference is now made to FIG. 4, showing a flowchart of an embodiment of environmentally sustainable method 100 of toilet flushing and blackwater disposal, by a means of a mechanical system. Method 100 of the embodiment of FIG. 4 illustrates various features that may be interchangeable with elements and/or features of any other embodiment described in the specification.

In some embodiments, method 100 comprises step 102 of collecting blackwater in a toilet bowl and conducting the blackwater to the toilet bowl through a bowl outlet at a bottom portion of the bowl. In some embodiments, method 100 further comprises step 104 of moving a sealing element of a bowl valve adjacently to the bowl outlet. In some embodiments, method 100 further includes step 106 of engaging the sealing element is vis-à-vis the bowl outlet, thereby sealing the bowl outlet and obstructing flow of blackwater therethrough.

In some embodiments, method 100 further comprises step 108 of disposing the sealing element offset the bowl outlet, thereby unsealing the bowl outlet and forming a conduit for flow of blackwater therethrough. In some embodiments, method 100 further includes step 110 of pumping the blackwater downstream to the bowl valve, by a pumping mechanism. In some embodiments, step 110 includes controllably forming, in turn, negative pressure downstream to the bowl valve and positive pressure downstream to the bowl valve.

In some embodiments, method 100 further comprises step 112 of conducting a flow of blackwater in a downstream direction relative to the pumping mechanism by a check valve, as well as obstructing the flow of blackwater in an upstream direction relative thereto. In some embodiments, method 100 further includes a step of storing the blackwater pumped by the pumping mechanism through the check valve into a blackwater reservoir.

In some embodiments, method 100 further includes a step of effectively preventing a backflow of blackwater in the upstream direction, from the pumping mechanism to the bowl valve, by an anti-backsplash check valve, disposed in-between the bowl valve and the pumping mechanism.

In some embodiments, method 100 further comprises step 114 of operationally connecting a driving shaft to an actuator and exerting a rotational torque onto the driving shaft. In some embodiments, method 100 further includes step 116 of operationally connecting the pumping mechanism with the bowl valve and with the driving shaft, according to a predefined gearing ratio of operation.

In some embodiments, the actuator is a human-powered drive, optionally comprising a convertor mechanism, configured to convert an essentially linear reciprocating motion of the human-powered drive, into a successive rotational movement of the driving shaft in the predefined direction. In some examples, the pumping mechanism is a diaphragm pump, in which the diaphragm, is operationally connected to the driving shaft.

In some examples, the human-powered drive comprises: a pedal-driven mechanism and/or a manual mechanism and/or a pedal, and/or a lever and handle, configured for exerting a human force onto the actuator. In some embodiments, where the actuator is an electromechanical drive, comprising an electrically powered motor, method 100 further comprises powering up the electrical motor.

In some embodiments, according to the predefined gearing ratio of operation, method 100 further includes step 118 of performing at least one single operational cycle by the pumping mechanism, in which each single operational cycle of the pumping mechanism comprises, in turn, forming negative pressure downstream to the bowl valve and positive pressure downstream to the bowl valve.

In another embodiment, according to the predefined gearing ratio of operation, method 100 further includes a step of performing two successive operational cycles by the pumping mechanism, in which each single operational cycle of the pumping mechanism comprises, in turn, forming the negative pressure downstream to the bowl valve and the positive pressure downstream to the bowl valve.

In some embodiments, according to the predefined gearing ratio of operation, method 100 further includes step 120 of performing a single operational cycle by the bowl valve, in which each single operational cycle of the bowl valve comprises, in turn, sealing the bowl outlet and obstructing flow of blackwater therethrough, and unsealing the bowl outlet and conduiting a flow of blackwater therethrough. In some embodiments, the predefined gearing ratio further comprises commencing the single operational cycle of the bowl valve, upon completion of a first phase of the single operational cycle, of the pumping mechanism.

In some embodiments, according to the predefined gearing ratio of operation, method 100 further includes step 122 of performing at least one single operational cycle by the driving shaft, in which each single operational cycle of the driving shaft comprises at least a partial revolution in a predefined direction. In another embodiment, according to the predefined gearing ratio of operation, method 100 further includes step 122 of performing two successive operational cycles by the driving shaft, in which each single operational cycle of the driving shaft comprises at least a partial revolution in a predefined direction.

In some embodiments, method 100 further comprises a step of driving the bowl valve into the open configuration by a ratcheting mechanism, operationally coupled to the bowl valve, only upon movement of the driving shaft corresponding to a second phase of the single operational cycle, of the pumping mechanism.

In some embodiments, method 100 further comprises a step of controllably conducting a flow of flushing water from a flushing water source to the toilet bowl. In some embodiments, method 100 further comprises operationally connecting a controller of a controllable shutoff valve to the driving shaft.

In some embodiments, method 100 further comprises a step of performing by the flushing shutoff valve a single operational cycle, in which each single operational cycle of the shutoff valve comprises, in turn, conducting a flow of flushing water from the source to the toilet bowl for a predetermined period of time, and then obstructing the flow of the flushing water from the source to the toilet bowl.

In some embodiments, method 100 further comprises a step of accumulating a potential mechanical energy by a biasing means for: performing the single operational cycle of the system and/or performing at least one single operational cycle by the driving shaft and/or returning the human-powered actuator into an initial position.

INDEX OF REFERENCE NUMERALS

Within the specification hereinabove inter alia the following numerals were used to denote the particular constituents in the appended drawings:

10—environmentally sustainable system
12—toilet bowl
14—bowl outlet
16—bowl valve
18—pumping mechanism
20—anti-backsplash check valve
22—check valve
24—blackwater reservoir
26—driving shaft
28—actuator
30—gearing mechanism
32—flushing subsystem
34—source
36—shutoff valve
40—biasing means
42—sealable access hatch
100—toilet flushing and blackwater disposal method
102—collecting blackwater
104—moving a sealing element adjacently to the bowl outlet
106—engaging the sealing element is vis-à-vis the bowl outlet
108—disposing the sealing element offset the bowl outlet
110—pumping the blackwater downstream to the bowl valve
112—conducting flow of the blackwater
114—operationally connecting a driving shaft to an actuator
116—operationally connecting in a predefined gearing ratio
118—performing two operational cycles by the pumping mechanism
120—performing a single operational cycle by the bowl valve
122—performing two operational cycles by the driving shaft.

It will be appreciated by persons skilled in the art of the invention that various features and/or elements elaborated in the context of a specific embodiment described hereinabove and/or referenced herein and/or illustrated by a particular example in a certain drawing enclosed hereto, whether method, system, device or product, is/are interchangeable with features and/or elements of any other embodiment described in the specification and/or shown in the drawings.

Moreover, skilled persons would appreciate that the present invention is not limited by what has been particularly shown and described hereinabove. Rather the scope of the invention is defined by the claims which follow:

The invention claimed is:

1. An environmentally sustainable system for toilet flushing and blackwater disposal comprises:

(a) a toilet bowl configured to collect a blackwater, comprising an essentially semi-spherical shell shape, said toilet bowl comprising a bowl outlet, at a bottom portion of said essentially semi-spherical shell shape, configured to conduct a flow of said blackwater therethrough;

(b) a bowl valve disposed adjacently to said bowl outlet, wherein said bowl valve comprising a movable sealing element, essentially matching said bowl outlet, configured upon movement of said sealing element for reversibly assuming:

(I) a bowl outlet sealing configuration, wherein said sealing element is engaged vis-à-vis said bowl outlet, thereby sealing said bowl outlet and obstructing said flow blackwater therethrough;

(II) an open configuration, wherein said sealing element is disposed offset said bowl outlet, thereby unsealing said bowl outlet and forming a conduit for flow of said blackwater therethrough;

(c) a pumping mechanism, operationally coupled downstream to said bowl valve, configured for controllably forming, in turn, a negative pressure downstream to said bowl valve and a positive pressure downstream to said bowl valve, thereby pumping said blackwater received from said bowl valve;

(d) a check valve, operationally coupled downstream to said pumping mechanism, configured to conduct a flow of said blackwater in a downstream direction relative to said check valve and to obstruct a flow of said blackwater in an upstream direction relative thereto;

(e) a driving shaft operationally connected to an actuator configured to exert a rotational torque onto said driving shaft;

(f) a gearing mechanism operationally connecting in a predefined gearing ratio of operation:

(I) said pumping mechanism, with (II) said bowl valve, with (III) said driving shaft;

(g) for each single operational cycle of said system, comprising a first phase and a second phase, said predefined gearing ratio of operation comprising:

(I) said pumping mechanism performing a single operational cycle, wherein each said single operational cycle of said pumping mechanism comprises, in turn, a first phase of forming said positive pressure downstream to said bowl valve, and a second phase of forming said negative pressure downstream to said bowl valve;

(II) said bowl valve performing a single operational cycle, wherein each single operational cycle of said bowl valve comprises, in turn, a first phase of sealing said bowl outlet and obstructing flow of said blackwater therethrough, and a second phase of unsealing said bowl outlet and conduiting a flow of said blackwater therethrough;

(III) said driving shaft performing a single operational cycle, wherein each said single operational cycle of said driving shaft comprises, in turn, a first phase of a partial revolution about a longitudinal centerline in a predefined direction, and a second phase of a partial revolution about said longitudinal centerline in a cornerwise direction to said predefined direction.

2. The system, as in claim 1, further comprises an anti-backsplash check valve, disposed in-between said bowl valve and said pumping mechanism, effectively preventing a backflow of said blackwater in said upstream direction, from said pumping mechanism to said bowl valve.

3. The system, as in claim 1, wherein said actuator is a human-powered actuator, further comprising a convertor mechanism configured to convert an essentially linear reciprocating motion of said human-powered actuator into a successive rotational movement of said driving shaft in said predefined direction.

4. The system, as in claim 1, wherein said actuator is a human-powered actuator, further comprising at least one member selected from the group consisting of: a pedal-driven mechanism, manual mechanism, pedal, lever and handle.

5. The system, as in claim 1, wherein said actuator is an electromechanical actuator, comprising an electrical motor-powered drive.

6. The system, as in claim 1, wherein said pumping mechanism is a diaphragm pump, wherein said diaphragm is operationally connectable to said driving shaft.

7. The system, as in claim 1, further comprises a flushing subsystem comprising a flushing water source, a controllable shutoff valve coupled to said flushing water source and configured to controllably conduct a flow of said flushing water from said source to said toilet bowl, wherein a controller of said shutoff valve is operationally connectable to said driving shaft.

8. The system, as in claim 1, further comprises a flushing shutoff valve, operationally connected to said driving shaft according to said predefined gearing ratio, wherein for each single operational cycle of said system, said flushing shutoff valve performs a single operational cycle, wherein each single operational cycle of said shutoff valve comprises, in turn, conducting a flow of a flushing water from said source to said toilet bowl for a predetermined period of time, and obstructing said flow of said flushing water from said source to said toilet bowl.

9. The system, as in claim 1, wherein according to said predefined gearing ratio, said single operational cycle of said bowl valve commences upon completion of said first phase of said single operational cycle, of said pumping mechanism.

10. The system, as in claim 1, further comprises a biasing means, configured to accumulate a potential mechanical energy for at least one member selected form the group consisting of:

(a) performing said single operational cycle of said system;

(b) performing said at least one single operational cycle by said driving shaft;

(c) returning said human-powered actuator into an initial position.

11. The system, as in claim 1, further comprises a ratcheting mechanism, operationally coupled to said bowl valve, configured to drive said bowl valve into said open configuration, only upon movement of said driving shaft corresponding to said second phase of said single operational cycle, of said pumping mechanism.

12. The system, as in claim 1, wherein said bowl valve is normally closed, being disposed in said bowl outlet sealing configuration, whilst idling.

13. The system, as in claim 1, further comprises a blackwater reservoir, operationally coupled downstream to said check valve, configured to store said blackwater pumped by said pumping mechanism through said check valve, wherein said blackwater reservoir is disposed at an altitude essentially exceeding an altitude of said pumping mechanism.

14. The system, as in claim 1, further comprises a sealable access hatch, disposed at an anterior portion of said system, configured to provide an access for maintenance and replacement.

15. An environmentally sustainable method of toilet flushing and blackwater disposal by a mechanical system comprises:

(a) collecting a blackwater in a toilet bowl and conducting a flow of said blackwater from said toilet bowl through a bowl outlet at a bottom portion thereof;

(b) moving a sealing element of a bowl valve adjacently to said bowl outlet;

(c) engaging said sealing element is vis-à-vis said bowl outlet, thereby sealing said bowl outlet and obstructing flow of said blackwater therethrough;

(d) disposing said sealing element offset said bowl outlet, thereby unsealing said bowl outlet and forming a conduit for flow of said blackwater therethrough;

(e) pumping said blackwater downstream to said bowl valve, by forming, in turn, a negative pressure to said bowl valve and a positive pressure downstream to said bowl valve;

(f) conducting a flow of said blackwater in a downstream direction relative to said pumping mechanism and obstructing said flow of said blackwater in an upstream direction relative thereto;

(g) operationally connecting a driving shaft to an actuator and exerting a rotational torque onto said driving shaft;

(h) operationally connecting in a predefined gearing ratio of operation:

(I) said pumping mechanism, with (II) said bowl valve, with (III) said driving shaft;

(i) for each sing operational cycle of said system, comprising a first phase and a second phase, said predefined gearing ratio of operation comprising:

(I) said pumping mechanism performing a single operational cycle, wherein each said single operational cycle of said pumping mechanism comprises, in turn, a first phase of forming said positive pressure downstream to said bowl valve, and a second phase of forming said negative pressure downstream to said bowl valve;

(II) said bowl valve performing a sing operation cycle, wherein each single operational cycle of said bowl valve comprises, in turn, a first phase of sealing said bowl outlet and obstructing flow of said blackwater therethrough, and a second phase of unsealing said bowl outlet and conduiting a flow of said blackwater therethrough;

(III) said driving shaft performing a single operational cycle, wherein each said single operational cycle of said driving shaft comprises, in turn, a first phase of a partial revolution about a longitudinal centerline a predefined direction, and a second phase of a partial revolution about said longitudinal centerline in a cornerwise direction to said predefined direction.

16. The method, as in claim 15, further comprises effectively preventing a backflow of said blackwater in said upstream direction, from said pumping mechanism to said bowl valve, by an anti-backsplash check valve, disposed in-between said bowl valve and said pumping mechanism.

17. The method, as in claim 15, wherein said actuator is a human-powered actuator, comprising a convertor mechanism, further comprises configured converting an essentially linear reciprocating motion of said human-powered actuator into a successive rotational movement of said driving shaft in said predefined direction.

18. The method, as in claim 15, wherein said predefined gearing ratio further comprises commencing said single operational cycle of said bowl valve upon completion of a first of said single operational cycle, of said pumping mechanism.

19. The method, as in claim 15, further comprises accumulating a potential mechanical energy by a biasing means, further comprises at least one member selected form the group consisting of:

(a) performing said single operational cycle of said system;

(b) performing said at least one single operational cycle by said driving shaft;

(c) returning said human-powered actuator into an initial position.

20. The method, as in claim 15, further comprises driving said bowl valve into said open configuration by a ratcheting mechanism, operationally coupled to said bowl valve, only upon movement of said driving shaft corresponding to said second phase of said single operational cycle, of said pumping mechanism.

* * * * *